US006669060B2

(12) United States Patent
De Laforcade

(10) Patent No.: US 6,669,060 B2
(45) Date of Patent: Dec. 30, 2003

(54) AIR INTAKE VALVE ARRANGEMENT

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 93 days.

(21) Appl. No.: 09/817,276

(22) Filed: Mar. 27, 2001

(65) Prior Publication Data

US 2002/0005417 A1 Jan. 17, 2002

(30) Foreign Application Priority Data

Mar. 27, 2000 (FR) ..... 00 03848

(51) Int. Cl.[7] ..... B65D 51/16

(52) U.S. Cl. ..... 222/321.1; 222/481.5; 222/482; 222/494; 137/854; 220/203.11; 220/203.13

(58) Field of Search ..... 137/852, 853, 137/854; 220/203.11, 203.13; 222/481.5, 494, 482, 321.1

(56) References Cited

U.S. PATENT DOCUMENTS

| | | | | |
|---|---|---|---|---|
| 3,454,182 A | * | 7/1969 | Morton | 137/852 |
| 3,511,407 A | * | 5/1970 | Palma | 220/203.13 |
| 3,705,668 A | | 12/1972 | Schwartzman | |
| 3,874,563 A | | 4/1975 | Schwartzman | |
| 4,401,224 A | * | 8/1983 | Alonso | 137/854 |
| 4,515,175 A | * | 5/1985 | Nolting et al. | 222/481.5 |
| 4,658,979 A | * | 4/1987 | Mietz et al. | 220/203.13 |
| 4,747,522 A | | 5/1988 | McIntyre | |
| 4,842,165 A | * | 6/1989 | Van Coney | 222/490 |
| 5,169,035 A | * | 12/1992 | Imbery, Jr. | 222/481.5 |
| 5,384,928 A | * | 1/1995 | Khoury | 137/854 |
| 5,718,383 A | | 2/1998 | Smith et al. | |
| 6,200,261 B1 | * | 3/2001 | Deininger et al. | 137/843 |

FOREIGN PATENT DOCUMENTS

| | | |
|---|---|---|
| DE | 41 19 634 | 12/1992 |
| EP | 0 500 249 | 8/1992 |
| GB | 1 058 323 | 2/1967 |
| GB | 2 169 384 | 7/1986 |

OTHER PUBLICATIONS

English language Derwent Abstract of DE 41 19 634, Dec. 17, 1992.

Co–pending Application—Attorney Docket No. 05725.0873–00000 Title: Cap for Dispensing Container Having Separate Dispensing Orifice and Air Intake Passage Inventor(s): Vencent De LaForcade, U.S. Filing Date: Mar. 27, 2001.

* cited by examiner

*Primary Examiner*—Kenneth Bomberg
(74) *Attorney, Agent, or Firm*—Finnegan, Henderson, Farabow, Garrett & Dunner LLP

(57) ABSTRACT

A valve element may be configured to be mounted in an air intake passage of a container. The valve element may be at least partially elastically deformable. The valve element may include a valving member configured such that, when vacuum pressure inside the container is less than a predetermined threshold differential from atmospheric pressure, the valving member is in sealed contact with a seat formed on the container. The valving member may also be configured such that the valving member moves away from the seat when the predetermined threshold differential is reached, so as to allow air to be taken into the container. By elastic return, the valving member may return to a position in sealed contact with the seat when the vacuum pressure inside the container drops back to less than the predetermined threshold differential. The valve element may be placed in a functional configuration via an elastically irreversible modification thereof during mounting.

80 Claims, 7 Drawing Sheets

AIR INTAKE VALVE ARRANGEMENT

Figure 1:
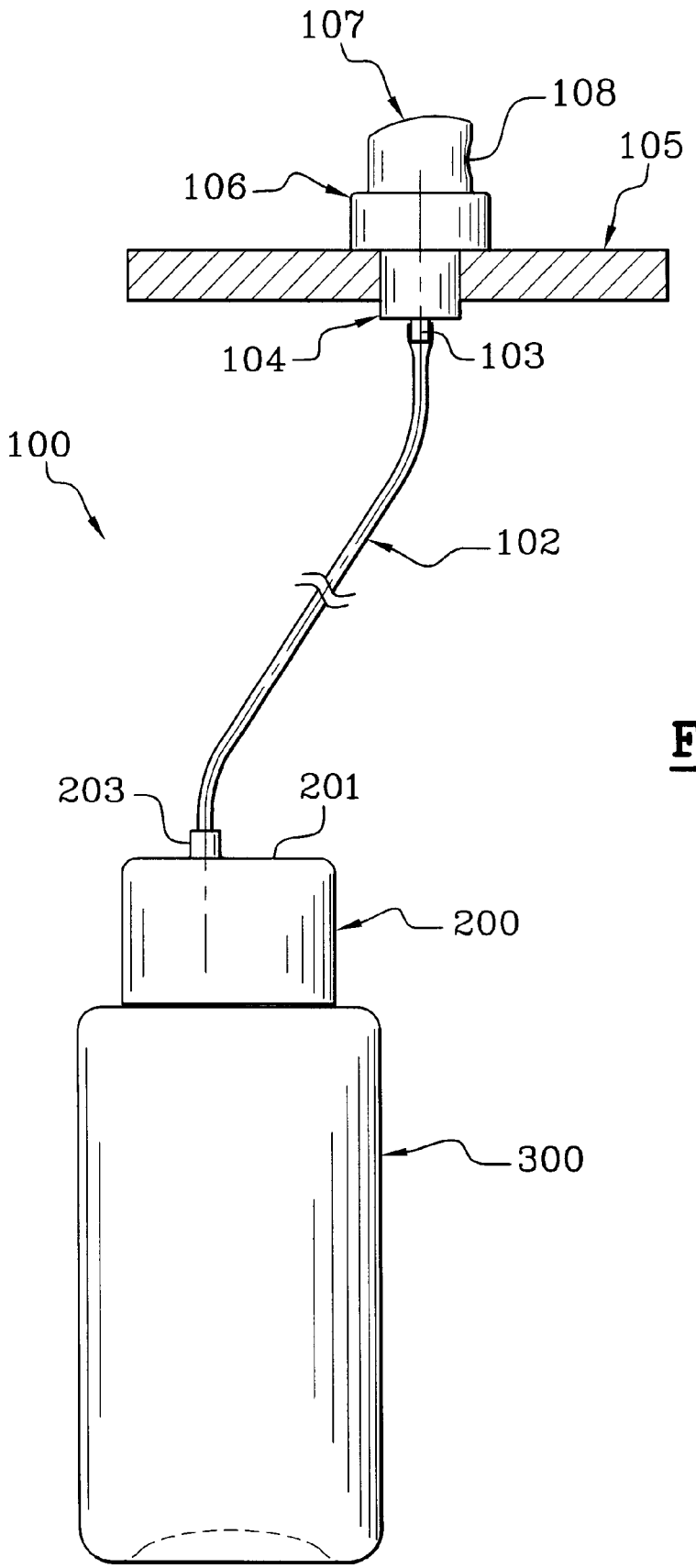

The present invention relates to the packaging and dispensing of fluid products, for example cosmetic products. The invention is aimed in particular at packaging and dispensing methods whereby the product is pumped from a container by means of a pump arranged outside of the container. More generally, the invention is aimed at any type of packaging entailing, for dispensing the product it contains, an air intake which does not deteriorate the overall sealing of the container.

In the field of perfumery for example, it is commonplace for product sale outlets to offer testers for products being sold, which allow the customers to test out the product before purchasing it. Usually, these testers consist of the same models as those intended for sale. The limited volume of these testers means often requires them to be renewed. Furthermore, the customers' assessment of the scents may be corrupted by the atmosphere laden with a mixture of vapors that may come from the various bottles of scent present at the test point. In addition, it is quite frequent for the testers to be removed or stolen from these test points. Finally, designers of such sales outlets are restricted in their creativity by the need to provide a very specific front location for the tester or testers.

It has been proposed that the pump be unattached and located away from the containers containing the scents. Thus, the pump, associated with its actuating member, can be mounted fixedly on a display counter and connected via a duct of some length to the container containing the scent, which container is located in a unit to which the customers do not have access. Thus, the risk of theft or breakage of scent bottles is minimized. The saving of space on display counters is substantial. The containers containing the scents can be of larger capacity. The vapors from the bottles may be confined inside a closed unit.

In conventional manually-operated pumps, the pump is sealed and air is taken in at the bottom of the stroke of the pump. Such an air intake is needed to compensate for the volume of product dispensed, without which the reduced pressure occurring inside the container could prevent the pump from operating. Thus, when the pump is mounted in the container, the intake of air into the container occurs without a problem each time the pump is operated. Such an air intake prevents the volatile components of the scent from evaporating in excessive proportion, thus preserving all the sensory qualities of the scent.

When the pump is delocalized from the container, the air intake, which is located at the bottom of the stroke of the pump, is no longer in communication with the container. Pump operation is soon blocked because of the excessive vacuum pressure inside the container. With such products containing highly volatile components, it is desirable to have a perfect seal. Thus, it is not possible to design the air intake in the form of a regulated air leakage used, for example, in devices for packaging less volatile products such as shampoos.

According to one aspect of the invention, a valve element configured to be mounted in an air intake passage of a container may be at least partially elastically deformable. The valve element includes a valving member configured such that, when vacuum pressure inside the container is less than a predetermined threshold differential from atmospheric pressure, the valving member is in sealed contact with a seat formed on the container. Further, the valving member may be configured such that the valving member moves away from the seat when the predetermined threshold differential is reached, so as to allow air to be taken into the container. By its elasticity, the valving member returns to a position in sealed contact with the seat when the vacuum pressure inside the container drops back to less than the predetermined threshold differential. The valve element may be placed in a functional configuration via an elastically irreversible modification thereof during mounting.

According to another aspect of the invention, a valve element for use with an air intake passage of a container may include a base portion, a skirt extending from the base portion, and a valving member on the skirt. The valving member may also include a free end. The valving member may be configured to be modified from an initial configuration, in which the free end extends in a first direction away from the base portion, to a second configuration, in which the free end extends in a second direction toward the base portion.

When the valve element is modified to the second configuration, the valve element may be configured so that it does not normally return to its initial configuration by its own elasticity. Such a configuration may be referred to as "elastically irreversible." It should be appreciated, however, that the valve element can be forcibly returned to its initial configuration, for example, to remove the valve element from the air intake passage.

In one embodiment, as long as the vacuum pressure generated in the container in response to the pumping of the product is not too great, the valving member bears elastically against the seat formed around the air intake passage, thus providing a good seal, for example, against the volatile components contained in the container. When the vacuum pressure reaches a certain threshold, it may become great enough to overcome the elasticity of the element and to force the part which makes the seal to detach from the seat so as to allow air to enter the container. When the vacuum pressure drops back below the threshold, the valving member may return automatically, by elastic return, into sealed contact with the seat, thus re-establishing a perfect seal of the container equipped with such an air intake. Thus, the inside of the container may be placed selectively in communication with the outside only at times when an ingress of air is desired.

The functional configuration of the valve element may be obtained by an elastic modification during mounting to make producing and mounting of the valve element easier, particularly when it is obtained by molding. Furthermore, this sequence may avoid potential problems associated with the manufacturing of the valve element and the container for which it may be intended.

The intake of air into the container may be via a continuous annular passage formed all around the element between an outer edge thereof and an inner edge of the passage in which the element is inserted. Alternatively, it may be formed of a plurality of discontinuous passages spaced uniformly at the periphery of the element.

In one embodiment, the valving member comprises a skirt. The valve element may be placed in functional configuration by at least partially turning the skirt back.

According to one embodiment of the invention, the skirt may be formed as a continuation of a foot portion of the element. When the valve element is in an air intake passage, the foot portion may be at least partially located inside the container. The valve element may be placed in functional configuration by turning the skirt back towards the seat onto the foot portion. A zone of the skirt turned back in this way may be in sealed contact with the seat when the vacuum pressure inside the container is less than the predetermined value.

The skirt may be shaped so that it has a flexibility such that it may be made from a wide choice of elastically deformable material. It is possible to use rubbers, such as nitriles or butyls, whose compatibility with products such as scents poses no problems. Further, by giving the skirt portion intended to be turned back a length which is slightly longer than necessary, a few variations around the turning-back zone will be allowed. The skirt may be shaped as a cylinder and may have various cross-sectional shapes, for example, circular, oval, square, rectangular, triangular, and the like. These variations may affect the bearing of the valving member on the seat without, however, preventing it from fulfilling its role satisfactorily.

According to one embodiment, the zone designed to provide sealing may be a zone of the skirt located away from the free edge of the skirt. The seat may be equipped with a rim with which the sealing zone of the skirt comes into sealed contact. For example, the sealing zone may be located a distance from the free edge of the skirt of between 0.5 and 3 mm. Thus, even more variation is allowed around the turning-back zone, which variation will affect which zone of the skirt will be in contact with the rim without, however, preventing it from fulfilling its role satisfactorily. The seat then comprises a rim formed by the container near the air intake passage and on which the sealing zone of the skirt presses in a sealed manner.

According to another embodiment, the sealing zone comprises of a lip formed by a free edge of the skirt.

According to another embodiment, the skirt may be turned back about a folding zone defined by an annular groove formed on the interior surface of the skirt. The groove encourages folding back. Furthermore, it may make it possible to prevent the folded-back portion from partially unfolding as a result of the elasticity of the material, as this may be prejudicial to the seal obtained. The annular groove may have a profile substantially in the shape of a V or U. It should be appreciated that still other profiles may be used for the annular groove.

The valve element may be formed entirely of elastomeric material. Alternatively, only the skirt intended to be turned back is made of elastomer. The rest, particularly the retaining means and the foot portion onto which the skirt is turned back, may be made of a nonelastomeric material. It may be possible for the entire valve element to be obtained by two-shot injection molding or by over molding.

The valve element according to the invention may be made, in full or in part, of an elastomeric material chosen from thermoplastic or crosslinked elastomers. By way of example, the elastomeric material may be made of nitriles, butyls, silicones, natural or synthetic latices, EPDMs, polyurethanes, blends of polypropylene and SBS, SEBS or EPDM, very low density polyethylene, blends based on polyester glycols (TPUs) or polyether glycols (PEBA and COPE), and flexible polyvinyl chlorides (PVCs). Depending on the embodiment adopted, such a material may be a hardness of from 20 Shore A to 40 Shore D and possibly from 40 Shore A to 75 Shore A. Its elasticity may range from 0.5 to 5 MPa and possibly from 0.8 to 2 MPa (tensile stress at 100% elongation).

The materials and the configuration of the valve element may be chosen according to the threshold value at which it is desirable to allow air to be taken into the container. Purely by way of example, in the case of a valve element intended to equip a container, the contents of which are withdrawn by means of a manually operated pump located outside the container, the predetermined threshold value for the vacuum pressure may be approximately 200 mbar (pressure with respect to atmospheric pressure). For certain applications, for example, in the case of a flexible-walled container from which the product it contains is expelled by pressurising the walls of the container, the sealing of the sealing zone of the valve element may be broken for lower vacuum pressure differentials.

The valve element may be held inside the air intake passage by retaining means which may include of a portion of the valve element having a diameter larger than the smallest diameter of the air intake passage inside which it is intended to be mounted. Within the meaning of the present invention, the term "diameter" is to be understood as meaning the diameter of the circle circumscribed by the cross-section of the element or the air intake passage.

According to another aspect of the invention, there is also produced a cap intended to equip a container designed in particular for packaging a cosmetic product. The cap may include means for mounting it on the container. The cap may further include at least one passage for outletting the product and a passage for air intake. The cap may also include a valve element, according to one of the above embodiments of the invention, mounted inside the air intake passage.

The air intake passage may be formed of a first portion and a second portion. The first portion, when the cap is in the position mounted on the container, may be turned towards the outside of the container and extend over part of the thickness of a wall of the cap in which the passage is made. The first portion has a first diameter. The second portion, when the cap is in the position mounted on the container, may be turned towards the inside of the container and extend over the remainder of the thickness of the wall. The second portion has a second diameter smaller than the first. Each of the portions extends respectively over about half the thickness of the wall in which the air intake passage is made.

The valve element may be held inside the air intake passage by retaining means which may include part of the valve element. The diameter of the valve element may be approximately equal to or smaller than the diameter of the first portion of the air intake passage and larger than the second diameter. The valving member, in its functional configuration, may have a minimal diameter greater than the second diameter. The difference in diameter between the retaining means and the first portion of the air intake passage makes it possible to make an annular space allowing air to pass when the valving member is not in sealed contact with the seat. However, in the case of roughly identical diameters, the passage for air may be produced by one or more channels.

The first portion of the air intake passage is separated from the second portion by a shoulder intended to be engaged with a corresponding shoulder formed by the valve element. One or more channels may be formed at least on the surface of one of the shoulders so as to form at least one passage for air towards the container when the valving member is not in sealed engagement with the seat.

According to one embodiment, the second portion of the air intake passage is extended by a rim towards the inside of the container. A sealing zone of the valving member may be capable of pressing in a sealed manner on the rim.

According to another embodiment, the part of the valve element facing the second portion of the air intake passage may be dimensioned so as to allow air to pass through the second portion when the valving member is not in sealed engagement with the seat. According to yet another embodiment, the part of the valve element located facing the second portion of the air intake passage occupies practically the entire passage when the valving member is in sealed contact with the seat. The elongation of this part in response to a vacuum pressure inside the container causes enough reduction in the cross section thereof to allow the passage for air as the vacuum pressure drops back below the predetermined value. Alternatively, the channels formed on the shoulder separating the first and second portions of the air intake passage are continued axially onto the lateral edge of the first and/or second portion of the air intake passage.

In particular, for aesthetic reasons, the thickness of the retaining member may be at most equal to the depth of the first portion of the air intake passage. Thus, the retaining member may not have excess thickness with respect to the surface of the cap.

The cap may be capable of placing the container in communication with a pump arranged outside the container via at least one duct arranged between the container and the pump. The cap may be configured to mount, particularly by force, and to communicate with the duct via the outlet passage. The duct may be arranged outside the container and connected to a pump. A dip tube may be arranged inside the container with a free end intended to be arranged approximately at the bottom of the container.

The duct and the dip tube may be forcibly mounted on appropriate adapter elements provided on each side of the cap. It should be appreciated that other mounting mechanisms may, however, be employed. Alternatively, the duct feeding the pump may pass in a sealed manner through an appropriate orifice made in the cap, and continue so as to have a free end arranged more or less at the bottom of the reservoir. As another alternative, the container may be intended to be used head down, which makes it possible to dispense with the use of a duct acting as a dip tube.

The cap mounting mechanism may be capable of allowing the cap to be connected or fixed, for example by screw-fastening or snap-fastening, on a neck of the container, a free edge of which delimits an opening. Such a cap may be obtained by molding a thermoplastic material, for example, a polyethylene or a polypropylene.

According to another aspect of the invention, a container may be configured to dispense a product, for example a cosmetic product, and equipped with an air intake element according to one of the aforementioned embodiments of the invention.

According to yet another aspect of the invention, a container may be configured to dispense a product, for example a cosmetic product, and equipped with a cap according to one of the aforementioned embodiments of the invention.

The container may comprise a rigid material, for example, thermoplastic, metal, glass, or ceramic. In the case of a container whose contents may be dispensed by pumping, the body of the container may comprise a rigid material, such as glass, for example for a scent. Alternatively, the contents of the container may be dispensed through an orifice equipped with a valve-type closure element capable of opening under the pressure of the product and of returning to its closed position when the pressure ceases. In this case, the product may be pressurized by exerting pressure on the elastically deformable walls of the container. Such a dispensing method may be suited for the dispensing of shampoos, sun creams, or personal hygiene products.

According to another aspect of the invention, a dispenser comprises a container and a valve arrangement on the container. The dispenser may further include a pump in flow communication with the container via at least one duct. Also, the dispenser may include an actuator configured to operate the pump and cause dispensing of product through at least one dispensing orifice.

According to yet another aspect of the invention, a method of dispensing a product includes providing a dispenser, actuating a pump to dispense product through a dispensing orifice, and directing the dispensed product to a surface region. The surface region may be an external body portion, and the product may be chosen from a hair product, a sun-protection product, a personal hygiene product, a scent product, and a care product.

According to another aspect of the invention, a method for assembling a valve arrangement for use with a container may include providing a stopper, where a portion of the stopper may be a hollow skirt. The method may also include inserting the stopper through a passage in a wall of a container and folding a portion of the hollow skirt outward and back on the stopper. In one embodiment, the method may also include forming the stopper, for example, by molding.

According to yet another aspect of the invention, a dispensing system may comprise a container containing a cosmetic product and a cap on the container. The cap may include an air intake passage separate from a fluid outlet. The dispensing system may also include a valve arrangement associated with the air intake passage to selectively allow air into the chamber, a surface spaced from the container, and a pump on the surface. The pump may be in fluid communication with the container.

In the dispensing system according to one embodiment, the valve arrangement may include a base portion, a skirt extending from the base portion, and a valving member on the skirt. The valving member may include a free end. The valving member may be configured to be modified from an initial configuration, in which the free end extends in a first direction away from the base portion, to a second configuration, in which the free end extends in a second direction toward the base portion. The valve arrangement may also include a valve seat formed on a surface associated with at least part of the air intake passage. The valving member may be configured to move toward and away from the valve seat.

According to another embodiment, the dispensing system may include a duct providing fluid communication between a pump and the container. The system may also include an actuator configured to operate the pump and dispense product through at least one orifice.

Such a system may be particularly suited for the packaging and dispensing of a cosmetic product, particularly a hair, personal hygiene, care, or make-up product or a scent.

Figure 2A:
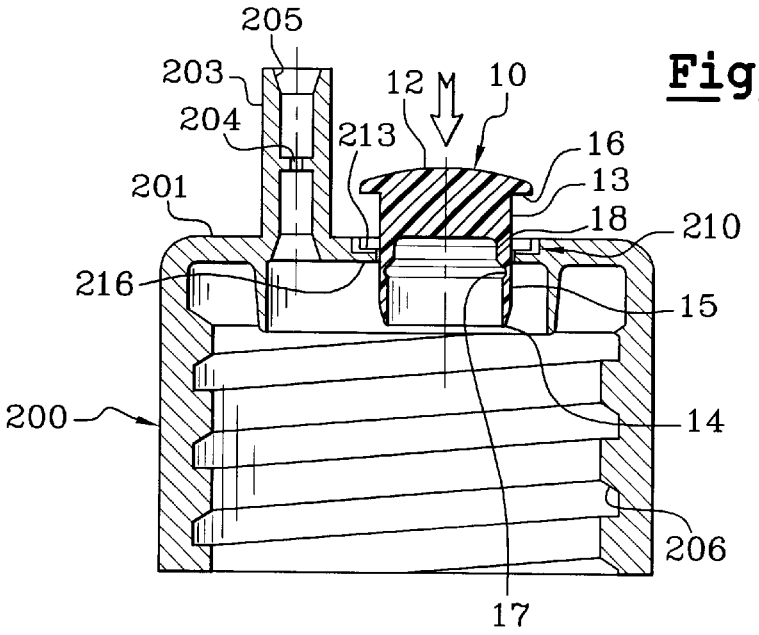
Figure 2B:
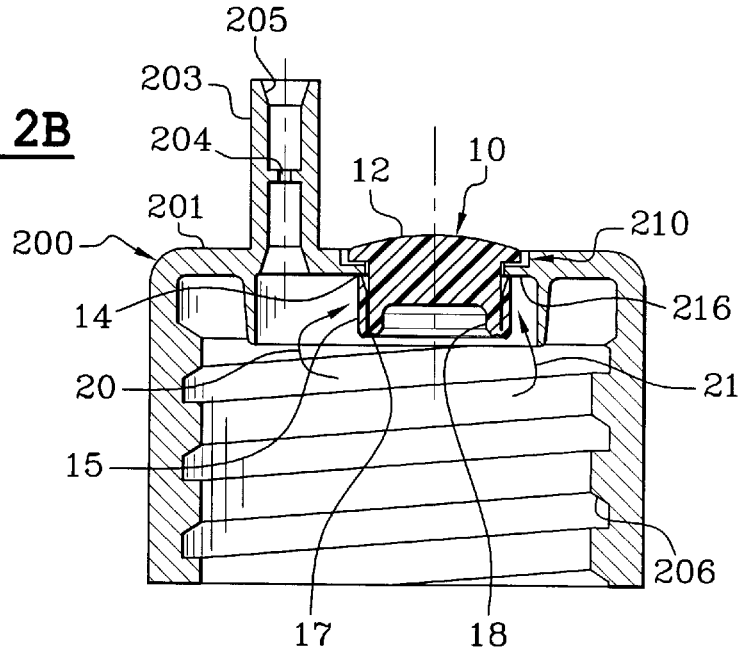
Figure 2C:
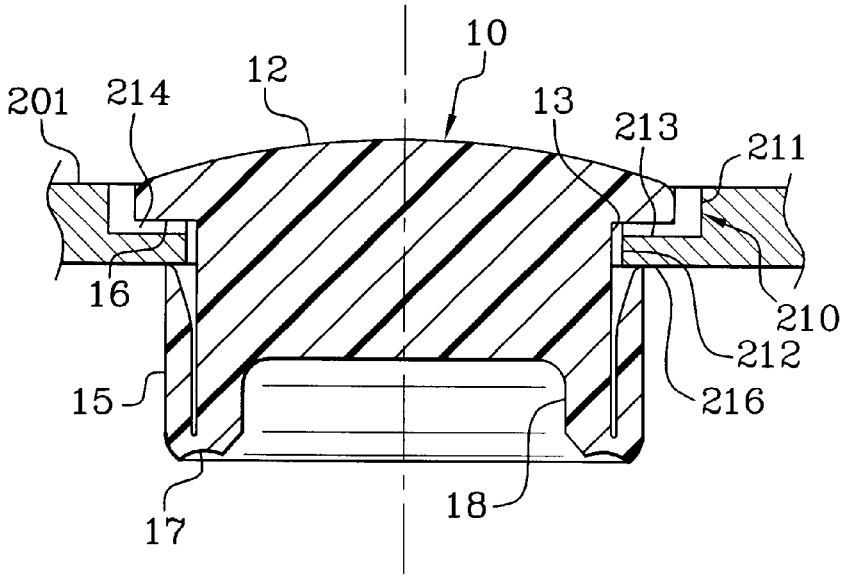
Figure 2D:
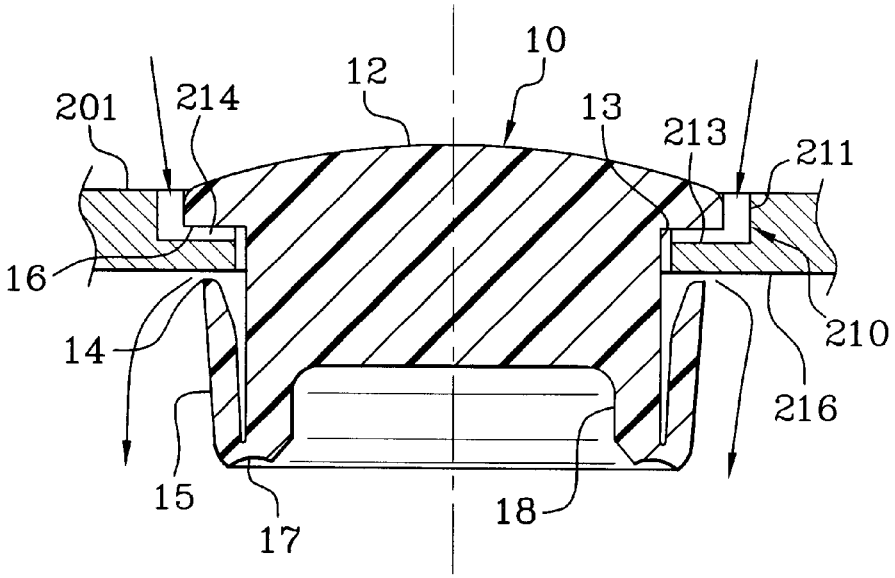
Figure 2E:
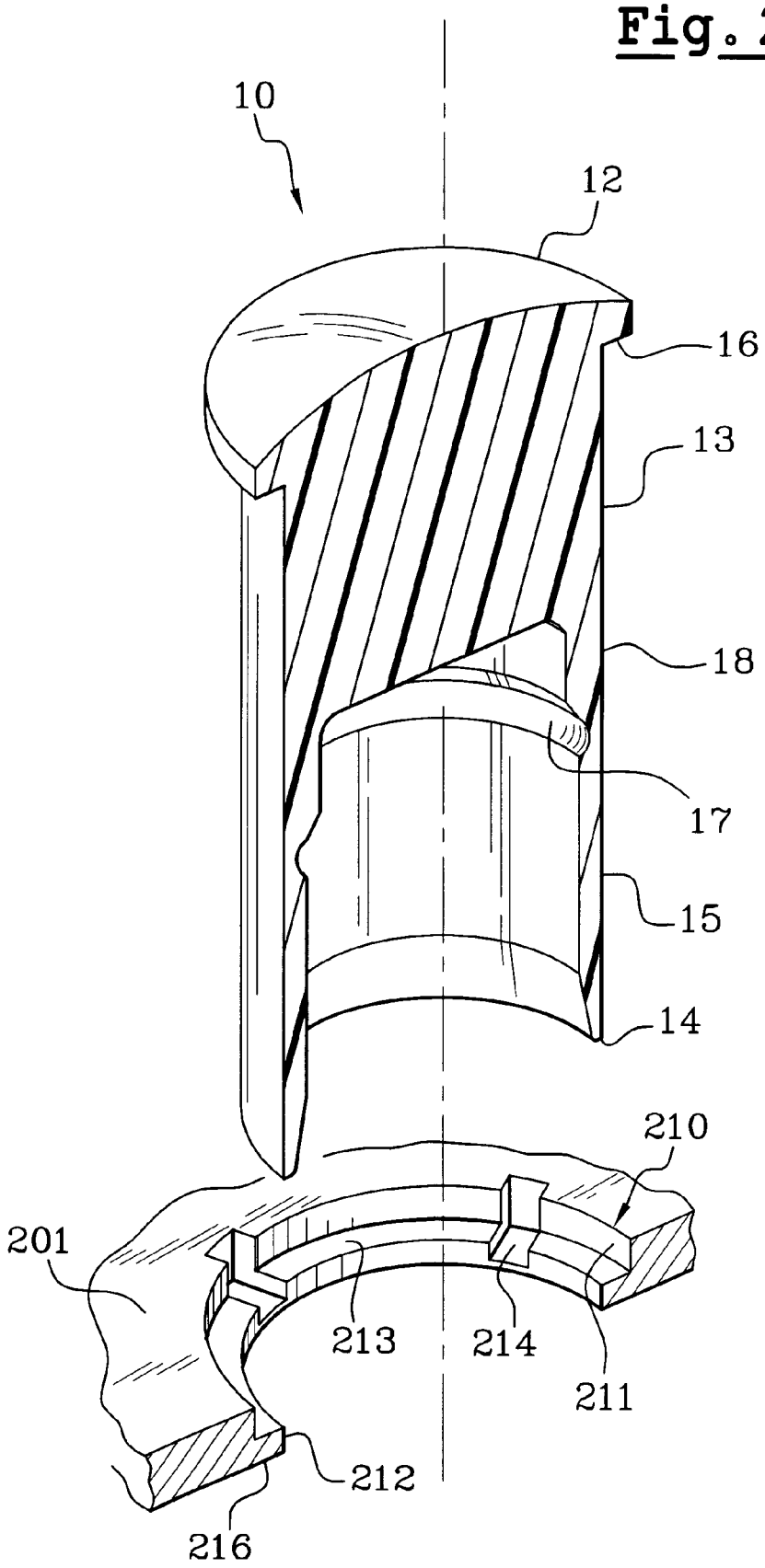
Figure 3A:
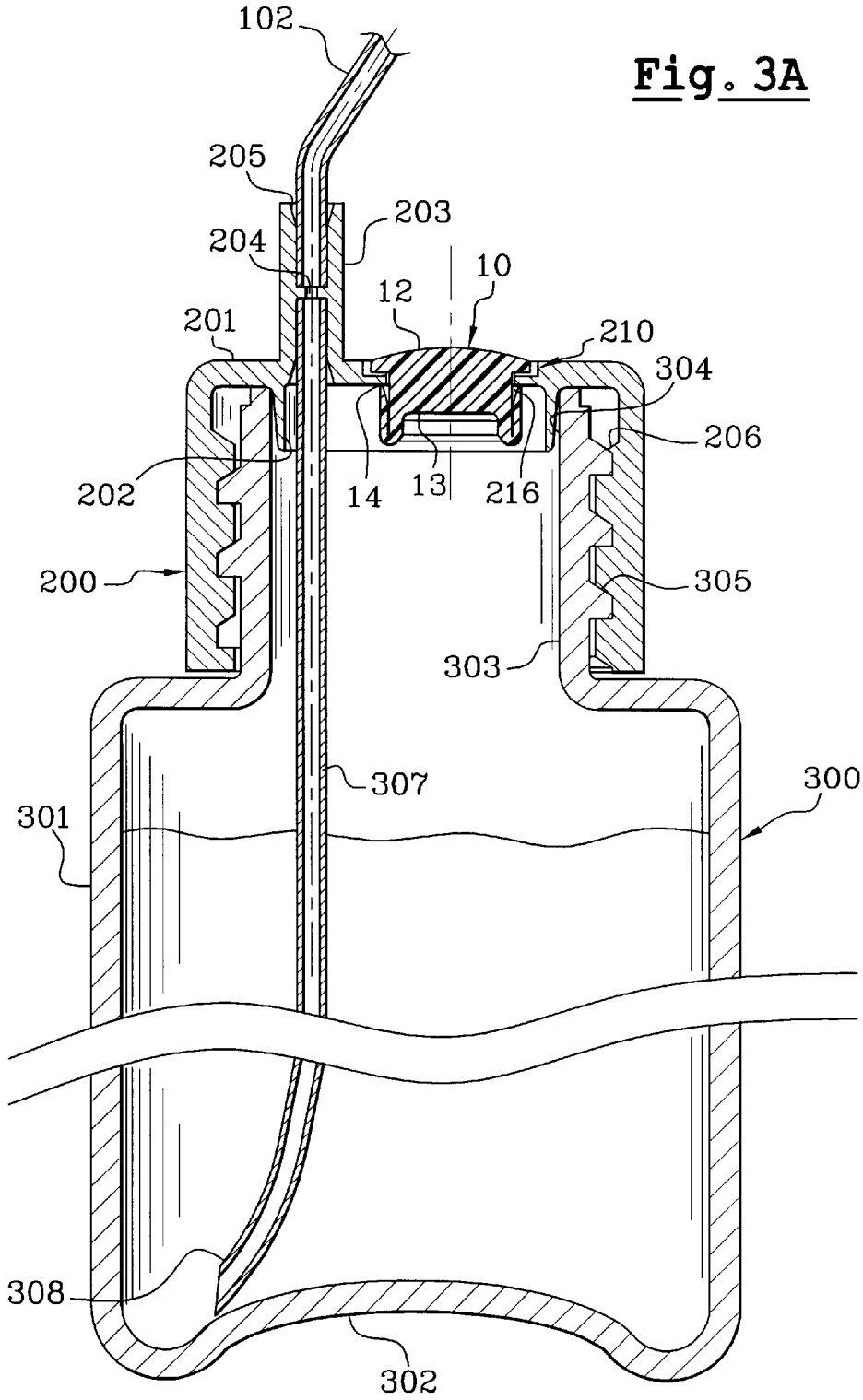
Figure 3B:
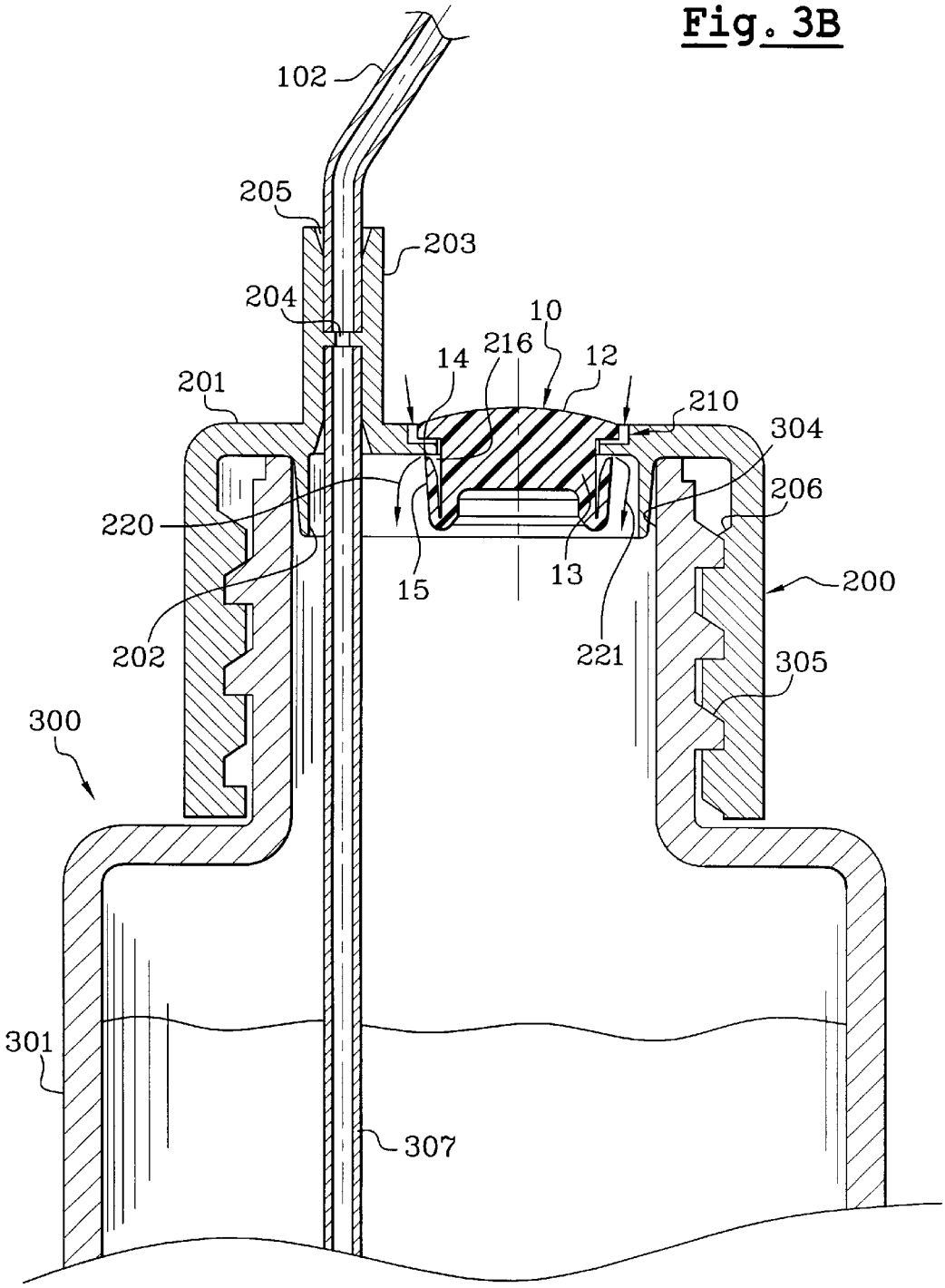
Figure 4A:
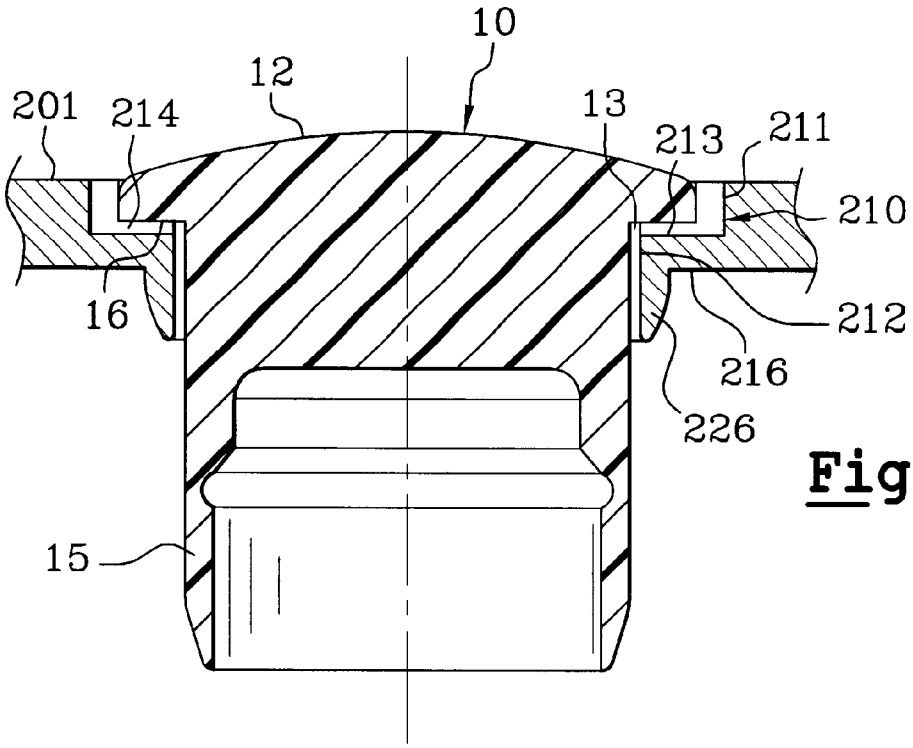
Figure 4B:
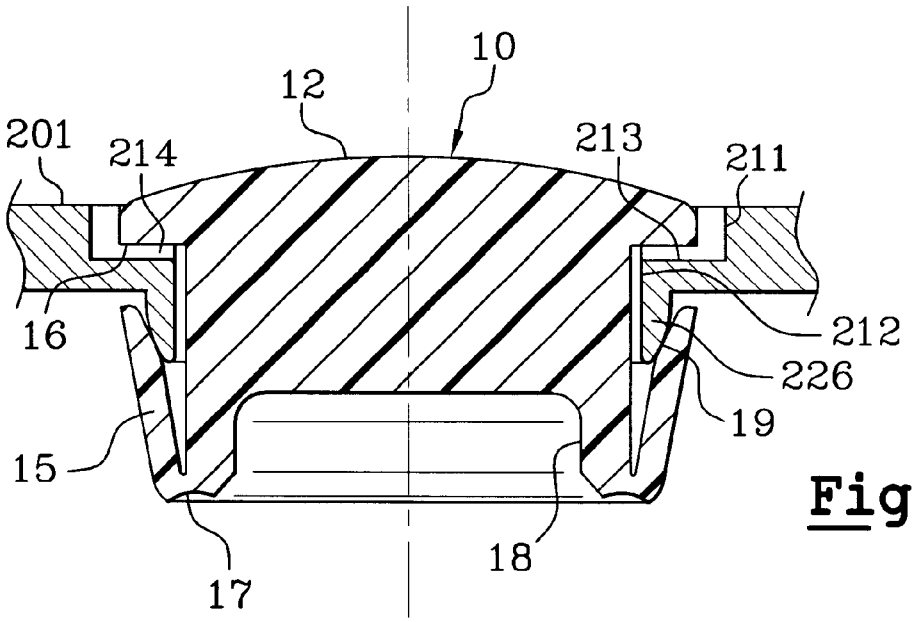

The invention comprises, apart from the provisions set out hereinabove, a certain number of other provisions which will be explained hereinafter with regard to some nonlimiting exemplary embodiments described with reference to the appended Figures among which:

FIG. 1 schematically depicts one embodiment of a dispenser equipped with an air intake element according to the invention;

FIGS. 2A–2B schematically depict a cap equipped with one embodiment of an air intake element according to this embodiment;

FIGS. 2C–2D give a detailed depiction of one embodiment of the air intake element according to this embodiment fitted into an air intake passage according to a first arrangement;

FIG. 2E gives a detailed depiction of one embodiment of the air intake element prior to mounting in the air intake passage;

FIGS. 3A–B illustrate a container equipped with a cap according to FIGS. 2A–2E; and FIGS. 4A–4B depict the air intake element according to FIGS. 2A–2E, fitted into an air intake passage according to a second arrangement.

The unit 100 depicted in FIG. 1 comprises a container 300, for example a glass bottle containing scent, on which a cap 200 may be mounted. A transverse wall 201 of the cap has a sleeve tube 203 passing through it, into which tube a first end of a duct 102 in communication with the container is forcibly inserted. The other end of the duct 102 is force-fitted onto an inlet sleeve tube 103 of a pump 104 mounted on a surface 105. The surface may comprise, for example, a cosmetic counter or a perfumery display counter, for example, at a retail store or showroom. The pump 104 has an actuator 106 including a movable actuating member 107 configured in the form of a pushbutton, for example, to operate the pump 104 and to dispense the product through an outlet 108, such as a spray nozzle.

The wall 201 of the cap has, passing through it, an air intake passage (not depicted) in which an element (not depicted) is mounted. The element and passage will be described by a detailed description with reference to the embodiments described in the figures which follow.

The container 300 depicted in FIG. 3A comprises a body 301, for example a glass body, one end of which is closed by an end wall 302. At the opposite end to the end wall 302, the body 301 forms a neck 303, a free edge of which delimits an opening 304. The outer surface of the neck has a connector 305, for example a screw thread, designed to cooperate with a corresponding connector 206, for example a screw thread, provided on the interior surface of a cap 200, for example, a thermoplastic cap.

The cap 200 may be formed of an open cylinder, one end of which is closed by a transverse wall 201. The transverse wall 201 has a skirt 202 on its interior surface. The skirt 202 is capable of making a seal around the opening 304 of the container 300. The wall 201 has a sleeve tube 203, for example a cylindrical sleeve tube, passing through it. The sleeve tube delimits an outlet passage 205 for the product, one end of which is on the outside of the container 300. The other end of the sleeve tube 203 is inside the body of the container 300. Inside the sleeve tube 203, at a level slightly below the transverse wall 201 there is an annular flange 204. The annular flange 204 is intended to form an abutment for an end of a dip tube 307 forcibly inserted into the sleeve tube from inside the container. The dip tube 307 has a free end 308 arranged substantially at the bottom of the container. The annular flange 204 also forms an abutment for one end of a duct 102 intended to be connected to a pump (not depicted) arranged outside the container 300. The end of the duct 102 is forcibly inserted into the sleeve tube 203 from outside the container 300.

The wall 201 of the cap 200 has an air intake passage 210 passing through it, inside which passage is a valve element 10 made, for example, of elastomeric material, for example, one based on silicone. The valve element 10 is described below with reference to the detailed views of FIGS. 2C and 2D.

Over approximately half the thickness of the wall 201, the air intake passage 210 comprises a first (outer) portion 211 continuing, over the remainder of the thickness of the wall, in a second (inner) portion 212 of smaller diameter than the first portion 211. The two portions 211, 212 are separated by a shoulder 213, on the surface of which there are formed a number of radial channels 214 which continue vertically along the lateral edge of the first portion 211 of the air intake passage. The channels 214 may also be continued vertically along the lateral edge of the portion 212 of the air intake passage. By way of indication, the first portion 211 may have a maximum diameter of about 10 mm. The second, inner portion 212 may have a diameter of about 8 mm. The depth of the channels 214 may be on the order of ¼ to ½ mm.

The valve element 10 intended to be inserted in the air intake passage 210 is depicted before mounting in FIGS. 2A and 2E. The element comprises a base 12 having a larger-diameter portion. The base 12 is intended to allow the valve element 10 to be retained inside the air intake passage 210. The maximum diameter of the base 12 is approximately equal to the inside diameter of the portion 211 of the air intake passage (at the tops of the channels 214). The base 12 is continued by foot portion 13, for example a solid cylindrical part, providing the connection between the base 12 and a skirt 15 which has a free edge. The foot portion 13 has a diameter slightly smaller than the inside diameter of the second, inner portion 212 of the air intake passage so as to leave an annular passage to allow the passage of air. A shoulder 16 is formed between the base 12 and the foot portion 13 and is designed to come into engagement with the shoulder 213 of the air intake passage 210. The axial height of the foot 13 is such that when the shoulder 16 is resting against the shoulder 213, the foot 13 protrudes significantly into the container.

According to the arrangement of the air intake passage depicted in FIGS. 2A to 2E, a sealing lip 14 is formed by the free edge of the skirt 15, the walls of which are thin, for example, on the order of 1 mm thick or less. The skirt 15 is itself formed in the continuation of a skirt 18 of greater thickness than the thickness of the walls of the skirt 15. The outer surface of the skirt 18 extends in the continuation of the outer surface of the foot portion 13. Where the skirts 15 and 18 meet, a groove 17, for example a V-shaped groove, is formed and, as will be seen in greater detail hereinafter, is intended to encourage the skirt 15 to be turned back onto the foot 13.

The mounting of the valve element 10 in the air intake passage 210 is illustrated in FIGS. 2A and 2B. In FIG. 2A, the valve element 10 in the as-molded condition, is introduced into the passage 210, the skirts 15 and 18 being in the continuation of the foot. The valve element 10 is pushed into the air intake passage 210 until the shoulder 16 is in engagement with the shoulder 213. After it has been fully pushed in, the skirt 15 is turned back towards the outside of the valve element 10 (see arrows 20, 21 in FIG. 2B) so that it finds itself resting on the foot 13, the turning-back being at the groove 17. The length of the skirt 15 is chosen so that in the turned-back position illustrated in FIG. 2B, the lip 14 is more or less elastically compressed between the turning-back groove 17 and the interior surface 216 of the cap, delimiting the passage 210. This interior surface 216 therefore forms a seat on which the sealing lip 14 elastically rests.

In FIGS. 3A and 3B, the container 300 is equipped with a valve element 10 according to the embodiment discussed with reference to FIGS. 2A–2E. Each time the pump is operated, a vacuum pressure is created inside the container 300. As long as the vacuum pressure inside the container 300 is below the threshold differential value allowing air intake, the lip 14 of the valve element 10 is in sealed contact with the seat 216 (FIGS. 2C and 3A). Thus, the container 300 is perfectly sealed.

As is apparent in FIG. 2D, when the vacuum pressure reaches a predetermined value, the skirt 15 moves radially away from the foot portion 13 onto which it is turned back.

In so doing, the lip 14 is no longer in sealed contact with the seat 216. Air is therefore drawn into the container 300 via the channels 214 and via the annular passage around the foot portion 13. This circulation of air is illustrated by the arrows 220 and 221 in FIG. 3B. When the vacuum pressure inside the container drops back below the predetermined differential value, the sealing lip 14 returns, by elastic return exerted by the skirt 15, to bear elastically on the seat 216. The sealing of the container 300 is then reestablished.

According to one alternative variation depicted in FIGS. 4A and 4B, the second portion 212 of the air intake passage is extended by a rim 226 near the air intake passage 210 and towards the inside of the container. By using such an arrangement, the zone of the skirt 15 designed to be in sealed contact with the seat 216 is, in this case, a zone 19 of the skirt 15 located away from the free edge of the skirt 15. The skirt 15 is turned back towards the outside of the valve element 10 so that it rests, in this arrangement, on the rim 226. The length of the skirt is chosen so that in the turned-back position illustrated in FIG. 4B, the zone 19 of the skirt comes into sealed contact with part of the rim 226.

In the foregoing detailed description, reference was made to some preferred embodiments of the invention. It is obvious that variations can be made thereto without departing from the spirit of the invention.

What is claimed is:

1. A valve element configured to be mounted in an air intake passage of a container, the valve element being at least partially elastically deformable, the valve element comprising:

a valving member configured such that, when vacuum pressure inside the container is less than a predetermined threshold differential from atmospheric pressure, the valving member is in sealed contact with a seat formed on the container, the valving member being configured such that the valving member moves away from the seat when the predetermined threshold differential is reached, so as to allow air to be taken into the container and, by elastic return, returns to a position in sealed contact with the seat when the vacuum pressure inside the container drops back to less than the predetermined threshold differential, the valve element having an at-rest configuration and being placed, during mounting, in a functional configuration via an elastically irreversible modification of the at-rest configuration.

2. The valve element according to claim 1, wherein the valving member comprises a skirt, the valve element being placed in the functional configuration by at least partially turning the skirt back.

3. The valve element according to claim 2, wherein the skirt comprises a foot portion, the foot portion being, when the valve element is in a mounted position, at least partially located inside the container, the valve element being placed in the functional configuration by turning the skirt back towards the seat onto the foot portion, a zone of the skirt turned back in this way being in sealed contact with the seat when the vacuum pressure inside the container is less than the predetermined threshold differential.

4. The valve element according to claim 3, wherein the sealing zone comprises a zone of the skirt located away from a free edge of the skirt.

5. The valve element according to claim 4, wherein the seat comprises a rim formed by the container near the air intake passage and on which the sealing zone of the skirt presses in a sealed manner.

6. The valve element according to claim 3, wherein the sealing zone comprises a lip formed by a free edge of the skirt.

7. The valve element according to claim 2, wherein the skirt is turned back about a folding zone defined by an annular groove formed on an interior surface of the skirt.

8. The valve element according to claim 7, wherein the folding zone has one of a V-shape and U-shape profile.

9. The valve element according to claim 1, wherein the valve element is at least partially made of an elastomeric material chosen from thermoplastic and crosslinked elastomers.

10. The valve element according to claim 9, wherein the material is chosen from nitrites, butyls, silicones, natural and synthetic latices, EPDMs, polyurethanes, blends of polypropylene and SIBS, SEBS, and EPDM, very low density polyethylenes, blends based on polyester glycols (TPUs) and polyether glycols (PEBA and COPE), and flexible polyvinyl chlorides (PVCs).

11. The valve element according to claim 1, further comprising a retainer configured to hold the valve element inside the air intake passage, the retainer comprising a head portion of the valve element having a diameter larger than a smallest diameter of the air intake passage inside which the valve element is intended to be mounted.

12. A cap configured for use with a container, the cap comprising:

the valve element of claim 1; and a connector configured to mount the cap on the container, the cap further comprising at least one passage for discharging product and a passage for air intake.

13. The cap according to claim 12, wherein the air intake passage comprises:

a first portion configured, when the cap is mounted on the container, to be turned towards the outside of the container, the first portion extending over part of a thickness of a wall of the cap in which the air intake passage is made, the first portion having a first diameter; and a second portion configured, when the cap is in the position mounted on the container, to be turned towards the inside of the container, the second portion extending over a remainder of the thickness of the wall, the second portion having a second diameter smaller than the first.

14. The cap according to claim 13, further comprising a retainer configured to hold the valve element inside the air intake passage, the retainer comprising a head portion of the valve element having a diameter no greater than the first diameter of the first portion of the air intake passage, the valving member, when in the functional configuration, having a minimal diameter greater than the second diameter of the second portion.

15. The cap according to claim 14, wherein the air intake passage further comprises a first shoulder separating the first portion from the second portion, the first shoulder being configured to be engaged with a corresponding second shoulder of the valve element, at least one channel being formed on the surface of one of the first shoulder and the second shoulder, the at least one channel forming at least one passage for air towards the container when the valving member is not in sealed engagement with the seat.

16. The cap according to claim 14, wherein the second portion comprises a rim, the rim extending towards an inside of the container, a sealing zone of the valving member being capable of pressing in a sealed manner on the rim.

17. The cap according to claim 14, wherein a thickness of the retainer is at most equal to a depth of the first portion of the air intake passage.

18. The cap according to claim 12, wherein the cap is configured to place the container in communication with a pump arranged outside the container via at least one duct arranged between the container and the pump.

19. The cap according to claim 18, further comprising:

a dip tube arranged inside the container, the dip tube having a free end which is intended to be arranged approximately at a bottom of the container; and a mount for providing communication between the at least one duct and the dip tube.

20. The cap according to claim 19, wherein the at least one duct is connected to the mount by force-fitting.

21. The cap according to claim 12, wherein the cap is configured to be fixedly attached to a neck of the container, the neck having a free edge delimiting an opening.

22. The cap according to claim 21, wherein the cap is fixedly attached to the neck by one of screw-fastening and snap-fastening.

23. The cap according to claim 12, further comprising a thermoplastic material.

24. The cap according to claim 23, wherein the thermoplastic material is chosen from polyethylene and polypropylene.

25. The cap according to claim 23, wherein the cap is molded.

26. A dispenser, comprising:

a container configured to contain a cosmetic product; and the valve element according to claim 1.

27. A dispenser, comprising:

a container configured to contain a cosmetic product; and a cap according to claim 12.

28. The dispenser of claim 26, wherein the container comprises a rigid material.

29. The dispenser of claim 28, wherein the rigid material is chosen from thermoplastic, metal, glass, and ceramic.

30. The dispenser according to claim 26, further comprising:

a pump arranged outside the container; and an actuator configured to operate the pump and dispense product.

31. The dispenser according to claim 30, further comprising at least one duct configured to connect the pump with the container.

32. The dispenser according to claim 31, wherein the pump comprises at least one orifice through which the product is dispensed.

33. The dispenser according to claim 32, further comprising a movable actuating member configured to operate the pump.

34. A method for dispensing a product, comprising:

providing the dispenser according to claim 30;

actuating the pump to dispense product through a dispensing orifice; and directing the product to a surface region.

35. The method according to claim 34, wherein the product is chosen from a hair product, a personal hygiene product, a care product, a make-up product or a scent product.

36. A valve element for use with an air intake passage of a container, the valve element comprising:

a base portion;

a skirt extending from the base portion; and a valving member on the skirt, the valving member having a free end, the valving member being configured to be modified from an initial configuration, in which the free end extends in a first direction away from the base portion, to a second configuration, in which the free end extends in a second direction toward the base portion and the valving member faces an outer surface of the skirt.

37. The valve element of claim 36, wherein the skirt is cylindrical.

38. The valve element of claim 36, wherein the valving member is in the second configuration.

39. The valve element of claim 38, wherein elasticity of the valving member biases the valving member to the second configuration.

40. The valve element of claim 39, wherein the valving member is substantially prevented from returning to the initial configuration by its own elasticity.

41. The valve element of claim 36, wherein the valve element is at least partially elastically deformable.

42. The valve element of claim 41, wherein the valve element at least partially comprises an elastomeric material chosen from thermoplastic and crosslinked elastomers.

43. The valve element of claim 42, wherein the elastomeric material is chosen from nitriles, butyls, silicones, natural and synthetic latices, EPDMs, polyurethanes, blends of polypropylene and one of SIBS, SEBS, and EPDM, very low density polyethylenes, blends based on polyester glycols (TPUs) and polyether glycols (PEBA and COPE), and flexible polyvinyl chlorides (PVCs).

44. The valve element of claim 36, wherein the valving member is modified from the initial configuration to the second configuration by turning back the valving member onto the skirt.

45. The valve element of claim 44, further comprising a folding zone defined by an annular groove, the valving member being turned back about the folding zone.

46. The valve element of claim 45, wherein the annular groove is formed in an interior surface of the skirt when the valving member is in the first configuration.

47. The valve element of claim 46, wherein the annular groove comprises one of a substantially V-shape and a substantially U-shape.

48. The valve element of claim 36, further comprising a sealing zone on the valving member.

49. The valve element of claim 48, wherein the free end of the valving member includes the sealing zone.

50. The valve element of claim 49, wherein the sealing zone comprises a lip formed by the free end of the valving member.

51. The valve element of claim 48, wherein the sealing zone is spaced from the free end of the valving member.

52. The valve element of claim 51, wherein the sealing zone faces radially inward toward the skirt when the valving member is in the second configuration.

53. The valve element of claim 36, wherein the valve element comprises a molded thermoplastic material.

54. The valve element of claim 53, wherein the molded thermoplastic material is chosen from polyethylene and polypropylene.

55. A valve arrangement, comprising:

the valve element of claim 36;

an air intake passage, the valve element being in the air intake passage; and a valve seat formed on a surface associated with at least part of the air intake passage, the valving member being configured to move toward and away from the valve seat.

56. A cap for a container, comprising:

the valve arrangement of claim 55;

a mounting mechanism configured to mount the cap on a container; and a passage configured to discharge a product.

57. The valve arrangement of claim 55, wherein the valving member includes a sealing zone when the valving member is modified from the initial configuration to the second configuration by turning back the valving member onto the skirt, the sealing zone configured to selectively sealingly contact the valve seat.

58. A cap for a container, comprising:

the valve arrangement of claim 57;

a mounting mechanism configured to mount the cap on a container; and a passage configured to discharge a product.

59. The valve arrangement of claim 57, wherein the free end of the valving member includes the sealing zone.

60. The valve arrangement of claim 59, wherein the sealing zone comprises a lip formed by the free end of the valving member.

61. The valve arrangement of claim 57, wherein the valve seat includes a rim proximal the air intake passage, the sealing zone being configured to sealingly contact the rim.

62. The valve arrangement of claim 61, wherein the sealing zone is spaced from the free end of the valving member.

63. The valve arrangement of claim 62, wherein the sealing zone faces radially inward toward the skirt when the valving member is in the second configuration.

64. The valve arrangement of claim 55, wherein the base portion and the valving member are configured to hold the valve element in the air intake passage.

65. The valve arrangement of claim 55, wherein the surface is on a wall and the air intake passage includes a first portion extending into part of a thickness of the wall, the first portion having a first diameter, and a second portion extending through a remaining thickness of the wall, the second portion have a second diameter smaller than the first diameter.

66. The valve arrangement of claim 65, wherein the base portion and the valving member are configured to hold the valve element in the air intake passage.

67. The valve arrangement of claim 66, wherein the base portion has a diameter no greater than the first diameter of the first portion and the valving member has a minimal diameter greater than the second diameter of the second portion.

68. The valve arrangement of claim 67, wherein the first portion is separated from the second portion by a first shoulder, and the valve element comprises a corresponding second shoulder for engaging the first shoulder.

69. The valve arrangement of claim 68, wherein at least one of the first shoulder and the second shoulder comprises a channel forming a passage for air from one side of the wall to another.

70. The valve arrangement of claim 65, wherein the base portion has a thickness no greater than the thickness of the first portion of the air intake passage.

71. The valve arrangement of claim 65, further comprising a rim extending from the second portion toward the valving member, the valving member comprising a sealing zone configured to sealingly contact the rim.

72. A dispenser, comprising:

a container;

the valve arrangement of claim 55, the valve arrangement being on the container;

a pump, the pump being flow connected to the container via at least one duct; and an actuator configured to operate the pump and cause dispensing of product through at least one dispensing orifice.

73. The dispenser of claim 72, wherein the container contains a cosmetic product.

74. The dispenser of claim 72, wherein the valving member includes a sealing zone when the valving member is modified from the initial configuration to the second configuration by turning back the valving member onto the skirt, the valving member being configured to selectively sealingly contact the valve seat.

75. The dispenser of claim 74, wherein the valving member sealingly contacts the valve seat when a pressure in the container is less than a predetermined pressure.

76. The dispenser of claim 75, wherein the valving member is configured to move away from the valve seat when the pressure in the container reaches the predetermined pressure.

77. The dispenser of claim 76, wherein air is taken into the container when the valving member is moved away from the valve seat.

78. A method of dispensing a product, comprising:

providing the dispenser of claim 72;

actuating the pump to dispense product through the dispensing orifice; and directing the dispensed product to a surface region.

79. The method of claim 78, wherein the surface region is an external body portion.

80. The method of claim 78, wherein the product is chosen from a hair product, a sun-protection product, a personal hygiene product, a scent product, and a care product.

* * * * *

UNITED STATES PATENT AND TRADEMARK OFFICE

CERTIFICATE OF CORRECTION

PATENT NO. : 6,669,060 B2
DATED : December 30, 2003
INVENTOR(S) : Vincent De Laforcade It is certified that error appears in the above-identified patent and that said Letters Patent is hereby corrected as shown below:

Column 10,
Line 11, "nitrites" should read -- nitriles --.

Signed and Sealed this

Twenty-fourth Day of February, 2004

JON W. DUDAS
*Acting Director of the United States Patent and Trademark Office*